United States Patent [19]

Rushing et al.

[11] 4,245,272

[45] Jan. 13, 1981

[54] APPARATUS AND METHOD FOR LOW SENSITIVITY CORONA CHARGING OF A MOVING PHOTOCONDUCTOR

[75] Inventors: Allen J. Rushing, Webster; Bruce R. Benwood, Spencerport; Paul A. LaChapelle, Fairport, all of N.Y.

[73] Assignee: Eastman Kodak Company, Rochester, N.Y.

[21] Appl. No.: 34,228

[22] Filed: Apr. 30, 1979

[51] Int. Cl.[3] ..... H01T 19/00

[52] U.S. Cl. ..... 361/229; 250/325

[58] Field of Search ..... 361/212, 213, 225, 229, 361/230; 250/324–326

[56] References Cited

U.S. PATENT DOCUMENTS

| | | | |
|---|---|---|---|
| 2,778,946 | 1/1957 | Mayo . | |
| 3,076,092 | 1/1963 | Mott . | |
| 3,456,109 | 7/1969 | Gawron . | |
| 3,527,941 | 9/1970 | Culhane et al. | 250/325 |
| 3,678,350 | 7/1972 | Matsumoto et al. . | |
| 3,912,989 | 10/1975 | Watanabe et al. | 361/229 |
| 4,141,648 | 2/1979 | Gaitten et al. | 355/14 |

*Primary Examiner*—Harry E. Moose, Jr.
*Attorney, Agent, or Firm*—John D. Husser

[57] ABSTRACT

Primary charging of a moving electrographic photoconductor to a nominal potential level is achieved with low sensitivity to variation in system parameters, such as photoconductor capacitance, photoconductor velocity and/or charger efficiency. Separately-addressed, AC corona discharge units are arranged and predeterminedly biased to first substantially overcharge the photoconductor relative to the nominal potential and then discharge the photoconductor to exit at the nominal potential level.

28 Claims, 12 Drawing Figures

FIG. 1
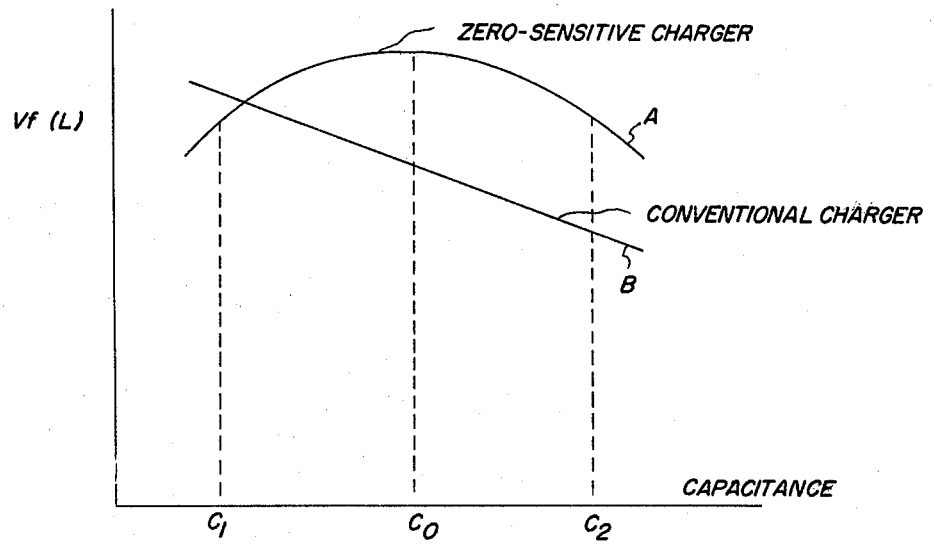
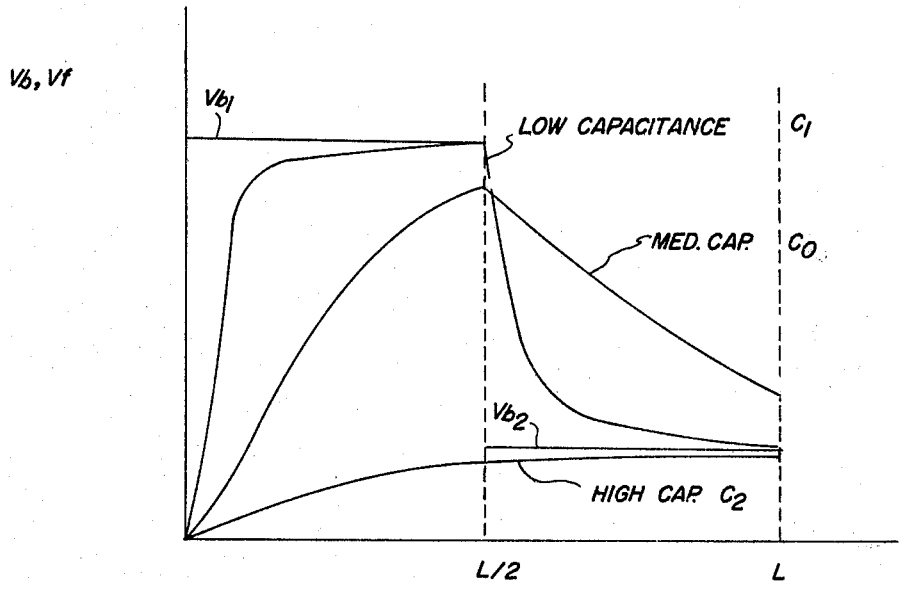
FIG. 2

FIG. 5
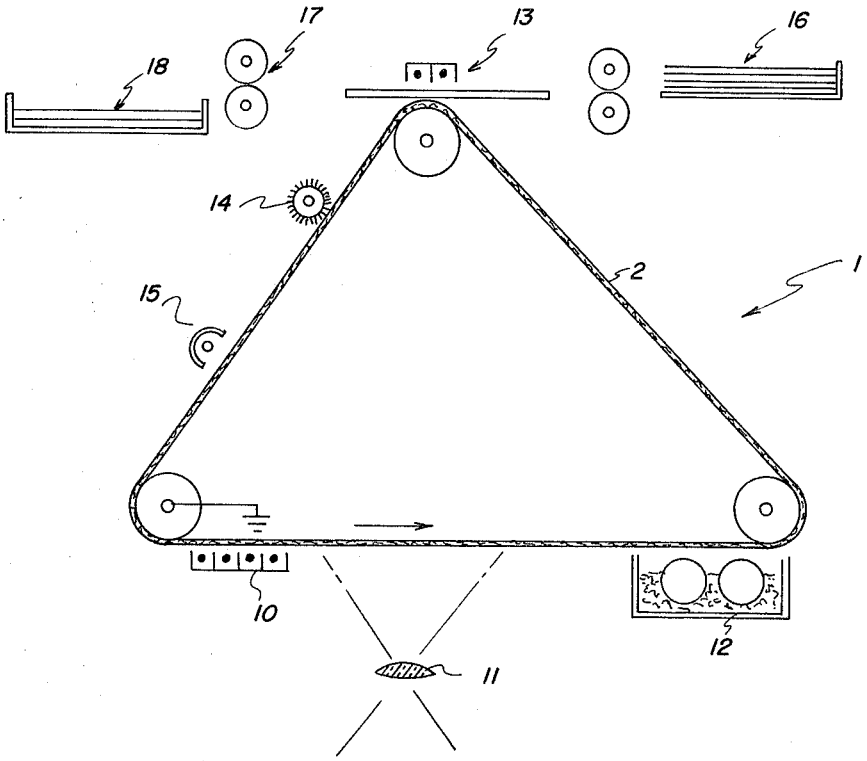
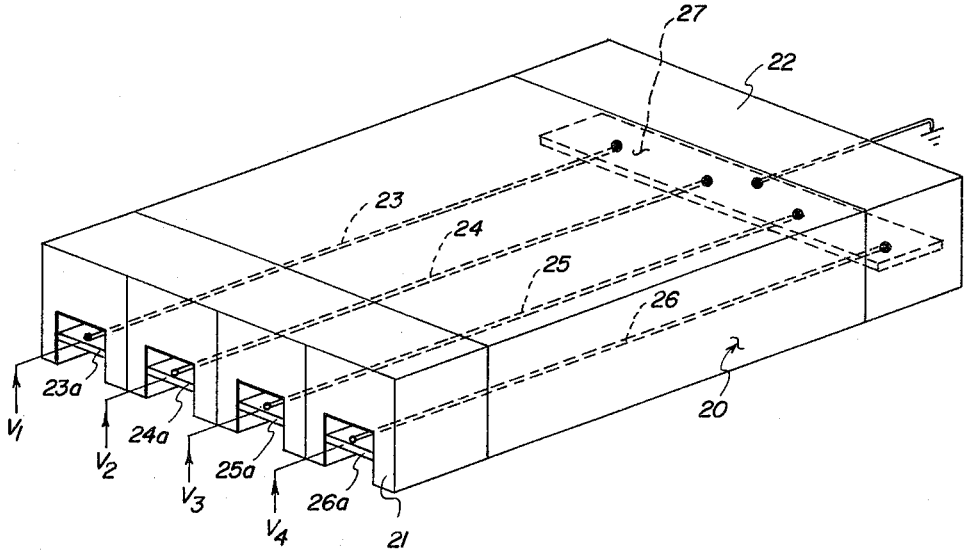
FIG. 6

APPARATUS AND METHOD FOR LOW SENSITIVITY CORONA CHARGING OF A MOVING PHOTOCONDUCTOR

BACKGROUND OF THE INVENTION

1. Field of the Invention

The present invention relates to electrophotographic apparatus and more particularly to such apparatus having improved corona discharge devices for effecting primary charging of moving photoconductors.

2. Description of the Prior Art

In the field of electrophotography the quality of the final image is affected significantly by the consistency of the primary, i.e., pre-exposure, charging of the photoconductor imaging member. Consistency in this sense includes both the overall uniformity of potential level throughout a particular image area and the constancy of such potential level with respect to each successive image area.

A certain amount of relative movement between the photoconductor surface and the charging unit is helpful towards achieving intra-image uniformity. However, in modern continuous copiers, e.g. of the type producing more than 3000 copies per hour, the problem of providing a constant potential level on successive photoconductor surfaces during the short period in which they rapidly pass the primary charging station is substantial.

For example, in such high speed operation variations in the photoconductor velocity, the photoconductor to discharge electrode spacing and the photoconductor capacitance all are possible causes for non-uniform charging. Also, variations in the efficiency of the charging device, caused, e.g., by change in humidity, barometric pressure or temperature, and by aging of the electrode and fluctuation in line current, present further chance for inconsistency of inter-image potentials.

Open wire DC corona chargers have a rapid charging rate which would be suitable for achieving adequate charge magnitude on such rapidly moving photoconductor at relatively low energizing potentials; however, these devices are highly sensitive to all or most of the system and environmental variables mentioned above.

Grid-controlled DC chargers are fairly insensitive to the variations characterized as the "charger efficiency" type because the level of charge applied by the devices is controlled by the field between the photoconductor surface and their fixed-potential grid. For this reason that technique has become a commercially preferred one for high speed applications. However, the level of energizing voltage required for grid-controlled devices to achieve proper charging at high photoconductor speeds produces a significant quantity of ozone. This aspect can necessitate safety devices and is sometimes damaging to operating parts of the copiers. In addition, grid-controlled chargers usually do not attain an equilibrium photoconductor potential in high speed charging; and the devices therefore continue to suffer a significant sensitivity to variations in photoconductor velocity, capacitance and spacing.

DC-biased AC charging devices present an alternative which is attrative (in comparison to grid-controlled charging) from the viewpoint of lessening ozone. These devices also can provide some degree of charge level regulation because a charging equilibrium is reached when charging current in the positive and negative cycles is equal (see e.g. U.S. Pat. No. 3,076,092). However, as in grid-controlled devices, this control is not complete when operating in high speed devices where charging time is insufficient to reach complete equilibrium. Thus such devices are also sensitive to variations in photoconductor velocity, capacitance and spacing. Further, since the control effect in DC-biased AC charging is based on a balance of charging current, these devices are also sensitive to variations in humidity, barometric pressure, temperature, electrode age and line current.

In view of the various problems connected with each of the different general techniques discussed above, a variety of hybrid or combination approaches have been suggested. For example, U.S. Pat. No. 2,778,946 discloses utilization of an initial open wire DC charger to place up to about 80% of the desired level of charge, followed by a grid-controlled DC charger which provides the remaining 20% required to establish the photoconductor surface at the desired primary charge level. This approach serves to facilitate operation of the grid-control effect closer to a zero photoconductor-grid field condition and therefore decreases the sensitivity of the system to variations in velocity, capacitance and spacing of the photoconductor. However, the system still remains sensitized in some degree to such variations, and the problem of production of ozone is not obviated. U.S. Pat. No. 3,678,350 discloses a similar approach but further provides for the sensing of the charge level intermediate the first and second charging devices and for adjustment of the second charger in accordance with the extent which the initial charge is below the desired level.

U.S. Pat. No. 3,456,109 discloses a different approach. This charging system uses two open wire DC corona chargers, one operative to charge the photoconductor to a saturation level with a first polarity charge and the other providing a subsequent, opposite-polarity charge which "modulates" the first charge and provides charge uniformity within an imaging area. However, it appears that this system remains susceptible to severe inter-image charge level differences created by variations in charging efficiency of the second "modulating" electrode and by variations in speed and spacing of the photoconductor during its movement therepast.

SUMMARY OF THE INVENTION

The present invention pertains to improvements for obviating the difficulties described above. Thus, it is an object of the present invention to provide improved apparatus and method for more consistently charging rapidly moving photoconductors and analogous dielectric members.

A more specific objective of the present invention is to provide method and apparatus for providing, on rapidly moving electrophotographic photoconductors, a uniform, predetermined primary charge, such apparatus and method having decreased sensi vity to variations in charger efficiency, photoconducto capacitance, photoconductor velocity and/or other such variable electrographic system parameters.

The above and other objectives and advantages are accomplished according to the present invention by: (1) initially corona charging such a moving dielectric member to an initial potential level which exceeds the nominal potential by a predetermined magnitude, and (2) subsequently corona discharging the member to reduce said initial potential to said nominal potential at the time of exit from the charging station. In one preferred embodiment said subsequent discharging is effected by subjecting the initially overcharged member to a bipolar corona current having a DC potential bias that is below the nominal potential level.

BRIEF DESCRIPTION OF THE DRAWINGS

FIG. 1 is a graph illustrating the variation of primary charge attained with respect to changes in photoconductor capacitance for conventional systems (curve B) and overcharge-discharge charging systems such as in accordance with the present invention (curve A);

FIG. 2 is a graph further illustrating the phenomena represented by curve A, FIG. 1;

FIG. 5 is a schematic diagram of one type of electrophotographic apparatus in which the present invention is useful;

FIG. 6 is a perspective view of one embodiment of charging device useful for practice of the present invention;

DETAILED DESCRIPTION OF PREFERRED EMBODIMENTS

Figure 3:
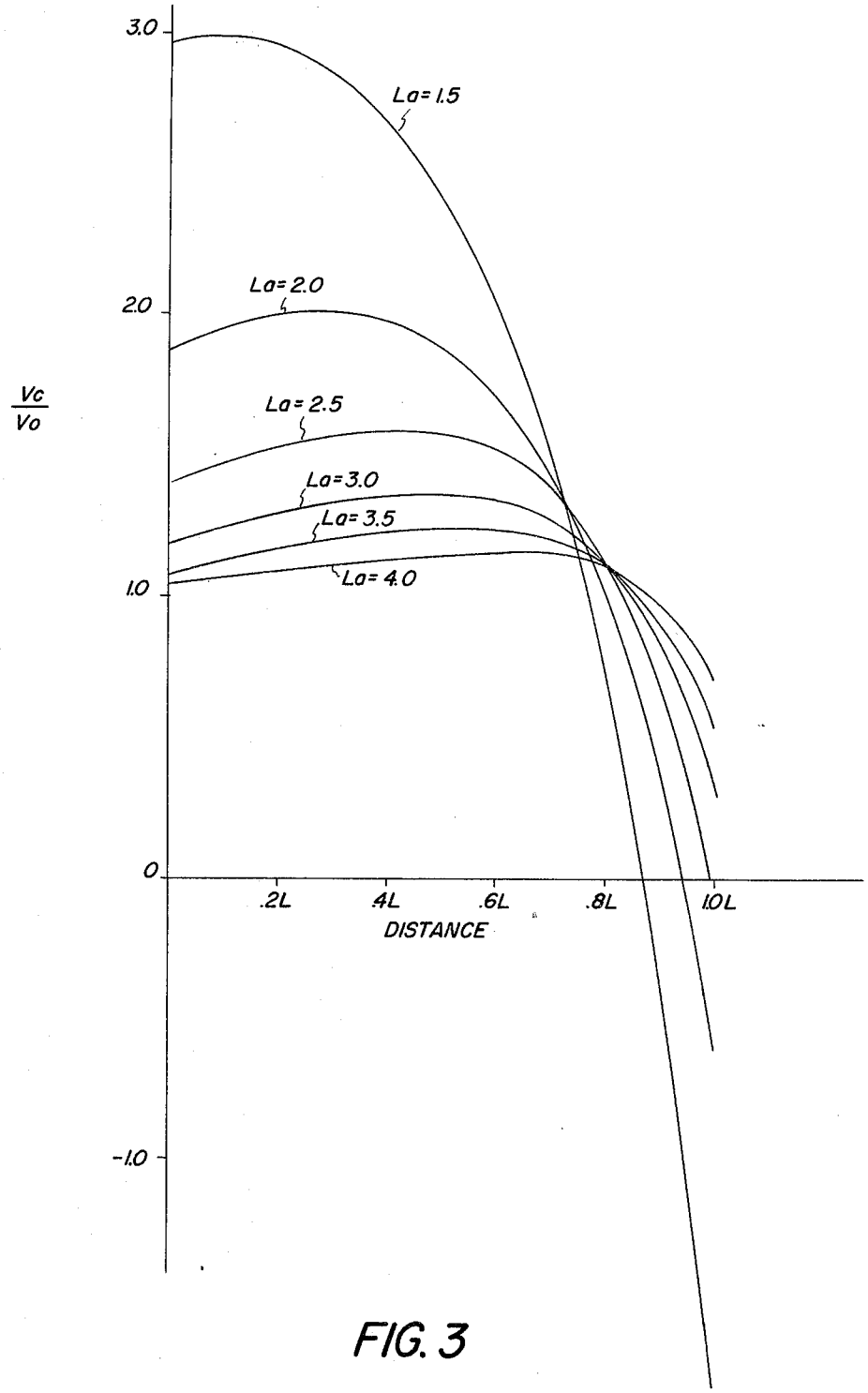
FIG. 3 is a graph illustrating optimal control voltages for certain ideal photoconductor charging systems having different "ease-of-charging" parameters.

Before describing several preferred embodiments for practice of the present invention, some preliminary explanation of the physical mechanisms involed will be useful. In this regard refer first to FIG. 1 which is a graph illustration of the variation of exit voltage with respect to capacitance variation for a photoconductor(s) passing two different corona charging stations. Curve A represents an exemplary plot for an overcharge-discharge system such as the present invention and curve B represents prior art systems charging continuously to, or toward, a single equilibrium level. As can be seen the photoconductor exit voltage attained with conventional charging systems, curve B, declines continuously with increasing film capacitance; however, in an overcharge-discharge system, curve A, the exit voltage first increases and then decreases with respect to increasing capacitance.

The curve A phenomenon can be more easily grasped by reference to FIG. 2, which shows a plot of voltage versus distance through (and thus charging time in) an overcharge-discharge system, for a photoconductor of low capacitance $C_1$, intermediate capacitance $C_o$ and high capacitance $C_2$. From the abscissa origin to L/2 each photoconductor is subjected to a charger biased generally to an overcharge potential $V_{b1}$ and from L/2 to L the photoconductor is subjected to a charger biased generally toward discharge potential $V_{b2}$. As shown the low capacitance film $C_1$ charges quickly and is discharged quickly to about $V_{b2}$, and the photoconductor of high capacitance $C_2$ charges much more slowly so as to obtain about the same exit voltage as the photoconductor of capacitance $C_1$. However, the photoconductor of intermediate capacitance $C_o$ initially charges above the potential $V_{b2}$ but does not discharge completely to the potential $V_{b2}$ during passage from L/2 to L. Considering these exemplary results, it will be seen why the overcharge-discharge system exhibits an "exit voltage" to "capacitance variation" curve such as A in FIG. 1, viz a curve which has a maximum and thus a zone of minimal slope at some value of intermediate capacitance.

In analyzing the foregoing from the viewpoint of minimizing the sensitivity of a primary charging system to variations in photoconductor capacitance, we theorized that, if an overcharge-discharge system were designed for operation in such a zone of minimal slope, the tolerance to capacitance variation will be significantly enhanced over prior art systems such as represented by curve B of FIG. 1. In reality, such an overcharge-discharge system exhibits the same increased tolerance to variations in photoconductor velocity through the charging station and to variations in charger efficiency.

Therefore the present invention contemplates predetermined overcharge-discharge primary charging which operates under nominal system parameters at a point within a zone of minimal slope on curve such as A in FIG. 1 and wherein the photoconductor exits the charging station at the nominal primary charge level. Thus when variations occur from the nominal parameters, e.g., film capacitance, film velocity or charger efficiency variations, the change in primary charge is minimal.

It can be seen, therefore, that selection of proper overcharge and discharge voltages is an important aspect of the present invention. The subsequent discussion outlines two techniques for estimating generally suitable voltages, taking into account the variable parameters of given charging systems. Thereafter a technique is described for adjusting such estimated voltages to achieve more optimum low-sensitivity charging. It will be appreciated that variations of these techniques or alternative techniques for selecting appropriate overcharge-discharge voltages may be utilized in accordance with the present invention.

In the design of a charging system according to either of the following techniques, it is necessary first to determine charge efficiency under nominal conditions. As used herein the term charger efficiency refers to the ratio of charging current density, from discharge electrode to photoconductor, per volt of potential difference between the instantaneous photoconductor surface potential and the equilibrium potential toward which the surface would charge if left stationary for a long time. This equilibrium potential is directly related to the DC bias level of a DC-biased AC charger or grid bias level of a grid-controlled charger. This equilibrium potential and charger efficiency can be determined experimentally for the system of interest by a stationary testing arrangement in which a biased plate is used to simulate the charging photoconductor. The DC-biased AC charger is located opposite the plate and energized with nomonal AC and DC bias source voltages. By varying the plate bias, the current flow to or from the plate at different plate potentials can be measured (e.g., with a resistor and digital volt meter). This data is linearly regressed, i.e., the current intensity is plotted as a function of simulator plate potential and a best-fit straight line curve is formed, the slope of which is the efficiency characteristic of the charging system. Dividing this characteristic by the effective charging area yields average charger efficiency K/2 (Amp/Volt-cm$^2$). The intercept of this straight line curve with the O current level abscissa defines what is hereinafter referred to as the control voltage $V_c$ (the voltage to which the photoconductor would charge if allowed to reach an equilibrium condition). In a biased grid charger the control voltage $V_c$ is typically approximately equal to the grid bias $V_b$. However in a DC-biased AC charging system the voltage $V_c$ differs from the bias voltage $V_b$. The relation of $V_c$ and K/2 to $V_b$ can be found for a given system by performing a polynomial regression on the values of K/2 and $V_c$ yielding equations of the form:

$$(K/2)(V_b)=A_o+A_1V_b+A_2V_b^2 \quad \text{(a)}$$

$$V_c(V_b)=B_o+B_1V_b+B_2V_b^2 \quad \text{(b)}$$

Having established the charger efficiency, a first technique for estimating appropriate charger voltages involves the formulation of an idealized graph such as shown in FIG. 3, which indicates for particular systems the effective $V_c$ (normalized for a desired exit voltage $V_o$) that is desired at various locations along the effective charging zone to obtain zero sensitivity. The different charging systems are characterized by their nominal parameters: photoconductor capacitance, length of charging zone, photoconductor velocity and charger efficiency which in combination provide an "ease of charging value", La for the system. The analytic technique for forming such La curves will now be described.

ANALYTIC TECHNIQUE FOR FORMING LA CURVES

When certain simplifying and ideal assumptions are applied to the DC-biased AC charger and the moving insulating film, an equivalent circuit model can be employed for analysis. The circuit is a series connection of DC voltage source $V_c$, resistance 2/K (reciprocal of charging efficiency) and film capacitance C, with voltage $V_f$ across the capacitor. Analysis of this circuit by Kirchoff's voltage law leads to the following differential equation which describes the operation of corona charging the free surface of an insulating film with underlying grounded conducting layer.

$$\frac{dV_f(t)}{dt} = -\frac{K}{2C}V_f(t) + \frac{K}{2C}V_c(t),\ V_f(0) = 0 \quad (1)$$

The independent variable may be changed from time t to distance x, by substituting $$t=x/v$$

where x is the distance toward the charger exit from the charger entrance, t is the time the corresponding film element has been within the charger, and v is the film velocity. This substitution yields $$\frac{dV_f(x)}{dx} = \frac{-K}{2Cv}V_f(x) + \frac{K}{2Cv}V_c(x)\ V_f(0) = 0 \quad (2)$$

$$0 < x < L$$

where $V_f(x)$=the film voltage (volts)

K/2=charger efficiency [A/(V-cm$^2$)]

C=film capacitance (F/cm$^2$)

v=film velocity (cm/s)

L=length of charger, in the direction of film velocity (cm)

$V_c(x)$=control voltage, i.e., the voltage toward which the film charges if left stationary at x for a long time, determined by the DC bias of the corona and other electrical and geometric parameter values of the particular configuration.

Equation (2) states that the rate of film voltage change with respect to distance, at position x, is proportional to the difference between control voltage and the present film voltage at position x. The constant of proportionality, K/(2Cv), depends directly on charger efficiency, K/2, and inversely on film capacitance and velocity. The idealizations and simplifying assumptions of equation (2) and the analysis that follows are:

1. The film is perfectly insulating.
2. No corona current outside the interval $0<x<L$.
3. Charging efficiency, K/2, has the same constant value over the interval $0<x<L$, and is independent of $V_c(x)$ and $V_f(x)$.
4. Negligible film voltage ripple of the frequency of the AC corona excitation. This implies that there are a great many AC cycles during the time an element of film is being charged.
5. No constraints on $V_c(x)$ and $V_f(x)$. In particular $V_c(x)$ is assumed continuously adjustable in the interval $0<x<L$.
6. C and v of a film element do not vary for that element while it is within the charging zone $0<x<L$.

Equation (2) can be simplified as:

$$\frac{dV_f}{dx} = -aV_f + aV_o,\ V_f(0) = 0 \quad (3)$$

where the parameter "a" lumps together charger efficiency K/2, film capacitance C, and film velocity v, i.e., a=K/2Cv. The sensitivity of equation (3) to variations in "a" is considered by first differentiating (3) term-by-term with respect to "a", yielding, $$\frac{dS(x)}{dx} = -aS(x) - V_f(x) + V_c(x),\ S(O) = 0 \quad (4)$$

where $$S = \frac{\partial V_f}{\partial a}\ (V.\ \text{cm}).$$

It is understood that variations in parameter "a" may be due to variations in K/2, C, or v.

Next, a control voltage function $V_c(x)$ is found that will drive the system defined by (3) and (4) to the desired exit film voltage $V_f(L)=V_o$, and the desired exit sensitivity $S(L)=S_o$. Many such $V_c(x)$ functions are possible and are deemed within the scope of this invention. However, the preferred optimal $V_c(x)$ function is the one which minimizes the performance index, $$J = \int_O^L [V_c(x) - V_o]^2 dx \quad (5)$$

and in addition produces the desired $V_o$ and $S_o$. The performance index of (5) penalizes deviations of $V_c(x)$ from the constant value, $V_o$, which would ultimately charge the film to the desired level, $V_o$, if the charger were long enough. It thus expresses the practical desire to avoid unnecessarily high bias levels and corresponding extremes in the film response, $V_f(x)$.

The above optimal control problem may be classified as a fixed-end-point, fixed-terminal-time (or distance) problem and will be solved by using the Pontryagin minimum principle (also known as the Pontryagin maximum principle) as outlined in standard texts of optimal control theory such as *Applied Optimal Control* by A. E. Bryson and Y. C. Ho, 1969, Chapter 2, or *Optimal Control* by M. Athans and P. L. Falb, 1966, Chapter 5.

For this type of optimal control problem the Hamiltonian, H. is formed by adjoining the integrand of J to the state equations (3) and (4) via the costate variables $p_1$ and $p_2$.

$$H=(V_c-V_o)^2+p_1(-aV_f+aV_c)+p_2(-aS-V_f+V_c)$$

where the costate variables are defined by $$p_1=\frac{-\partial H}{\partial V_f}=ap_1+p_2 \tag{6}$$

$$p_2=\frac{-\partial H}{\partial S}=ap_2 \tag{7}$$

The solution of (6) and (7) is given by $$p_2=D_2e^{ax}$$

$$p_1=D_1e^{ax}+D_2\times e^{ax}$$

where $D_1$ and $D_2$ are constants to be determined. The Pontryagin Minimum Principle states that the control function $V_c(x)$ which minimizes J will also minimize H, i.e., an optimal control will satisfy $$\frac{\partial H}{\partial V_c}=0=2V_c-2V_o+ap_1+p_2,\ 0\leqq x\leqq L$$

so that the optimal control is given by $$V_c=V_o-\tfrac{1}{2}[ap_1+p_2] \tag{8}$$
$$=V_o-\tfrac{1}{2}[a(D_1e^{ax}+D_2\times e^{ax})+D_2e^{ax}]$$

The constants $D_1$ and $D_2$ can be evaluated from the boundary conditions to completely specify the optimal control function, $V_c(x)$, and the film response, $V_f(x)$.

EVALUATION OF CONSTANTS

When the optimal control given by (8) is applied to the charger equation (3), the film response is given by the convolution of the impulse response and the control function.

$$V_f=\int_O^X e^{-a(x-y)}aV_c(y)dy$$
$$=V_o(1-e^{-ax})-\frac{D_2+2aD_1}{4}\sinh(ax)-\frac{D_2a}{4}\times e^{ax}$$

At x=L the film voltage is required to be $V_f(L)=V_o$, $$V_o=V_o(1-e^{-aL})-\frac{D_2+2aD_1}{4}\sinh(aL)-\frac{D_2a}{4}Le^{aL}$$

Solving for $D_1$, $$D_1=[-4V_oe^{-aL}-D_2aLe^{aL})/\sinh(aL)-D_2]-/2a=(-4V_oe^{-aL}-D_2aLe^{aL})/(2a\sinh(aL))-(D_2/2a) \tag{9}$$

A similar convolution gives the sensitivity, S(x).

$$S=\int_O^x e^{-a(x-y)}[V_c(y)-V_f(y)]dy$$
$$=\int_O^x e^{-a(x-y)}V_c(y)dy-\int_O^x e^{-a(x-y)}V_f(y)dy$$
$$=\frac{V_f}{a}-e^{-ax}\int_O^x e^{ay}[V_o(1-e^{-ay})-\frac{D_2+2aD_1}{4}\sinh(ay)-\frac{D_2a}{4}ye^{ay}]dy$$
$$=\frac{V_f}{a}-\frac{V_o}{a}(1-e^{-ax})+V_o\times e^{-ax}+\frac{D_2}{4}\times\sinh(ax)+\frac{aD_1}{4}\left(\frac{\sinh(ax)}{a}-xe^{-ax}\right)$$

At x=L, the sensitivity is required to be $S(L)=S_o$.

$$S_o=\frac{V_o}{a}-\frac{V_o}{a}(1-e^{-aL})+V_oLe^{-aL}+\frac{D_2L}{4}\sinh(aL)+\frac{aD_1}{4}\left(\frac{\sinh(aL)}{a}-Le^{-aL}\right)$$
$$=\frac{V_o}{a}e^{-aL}+V_oLe^{-aL}+\frac{D_2L}{4}\sinh(aL)+\frac{aD_1}{4}\left(\frac{\sinh(aL)}{a}-Le^{-aL}\right)$$

Substitute from (9) for $D_1$.

$$S_o=\frac{V_o}{a}e^{-aL}+V_oLe^{-aL}+\frac{D_2L}{4}\sinh(aL)+\frac{a}{4}\left[\frac{-4V_oe^{-aL}-D_2aLe^{aL}}{2a\sinh(aL)}-\frac{D_2}{2a}\right]\left(\frac{\sinh(aL)}{a}-Le^{-aL}\right)$$

Solving for $D_2$ yields $$D_2=\frac{8\left\{S_o-V_oe^{-aL}\left[\frac{1}{2a}+L+\frac{Le^{-aL}}{2\sinh(aL)}\right]\right\}}{\frac{-\sinh(aL)}{a}+\frac{aL^2}{\sinh(aL)}} \tag{10}$$

Thus, by determining $D_1$ and $D_2$, equations (9) and (10), for the charging system in question and then solving equation (8) for different values of x, a curve such as shown in FIG. 3, can be formed, indicating the optimum voltage $V_c$ for different distances into the charging zone.

Note that for a given Vo, So, and L, the functions $V_f(x)$ and $V_c(x)$ depend only on "a". Since the dimensions of "a" are the reciprocal of the dimension of L, the optimal $V_c(x)$ and $V_f(x)$ responses may be considered functions of the dimensionless product La. Recognizing the characteristic system distance constant as 1/a, the product La is then the number of characteristic distance constants in the length of charger. The product La may thus be considered a measure of the "ease of charging" in a particular configuration and several illustrative La curves are plotted in FIG. 3. The FIG. 4 graph shows theoretical film voltage values (normalized to $V_o$) as a function of position through the charging station; the FIG. 3 $V_c$ levels are utilized.

Figure 4:
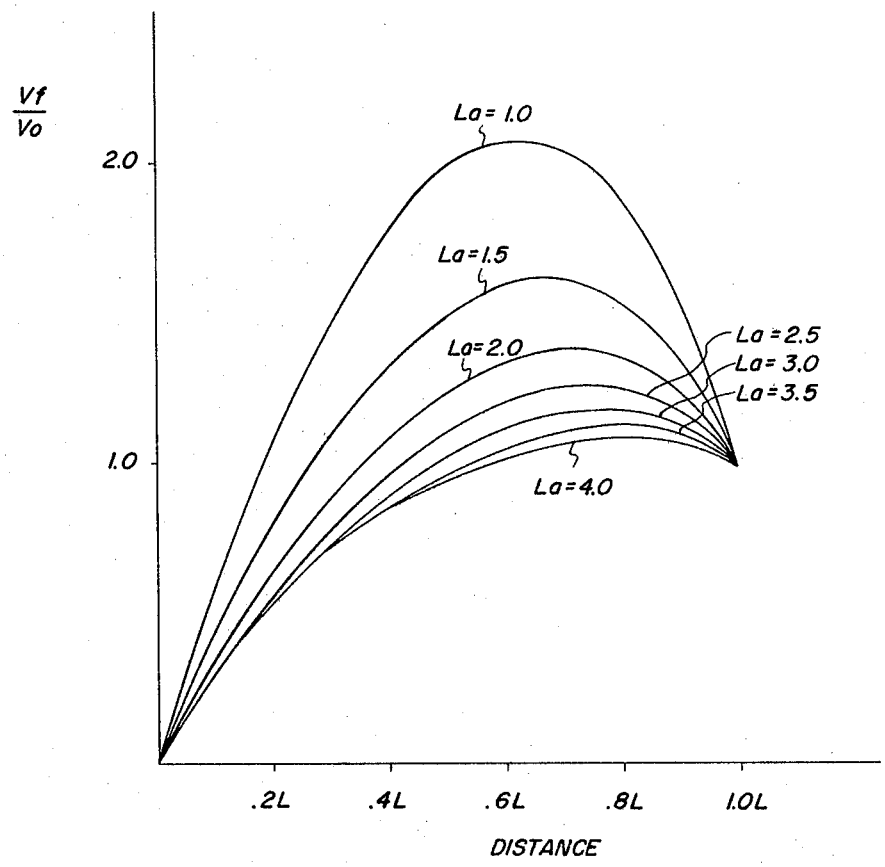
FIG. 4 shows the expected photoconductor voltage responses for charging systems implemented according to FIG. 3.

The closed-form analytic expressions for $V_c$ and $V_f$, plotted in FIG. 3 and FIG. 4, offer a means for fast direct (rather than iterative) estimations of optimal control and film response, especially when the number of corona wires is not specified.

It will be noted that the La curves in FIG. 3 define a control voltage $V_c$ which varies continuously throughout the length of the charging station. Of course this could be implemented only with a station having an infinite number of differently biased corona chargers. In practice, this is not feasible; and it is desirable to have the minimum number of separately biased charging units that will accomplish the desired result for the system parameters involved. At least two corona wires are required for practice of the present invention the first predeterminedly overcharging above the nominal voltage and the second predeterminedly discharging so that the photoconductor exits the charging station at the nominal level. If more wires are required, e.g., because of extreme film velocity or capacitance, at least half should be overcharging and the remainder discharging.

For purpose of illustrating the utility of the La curves with a finite number of charges, consider how an approximate control voltage Vc can be selected for a five-wire charging unit using the FIG. 3 curves. In this regard assume the system to be represented by the La 2.0 curve, and that the wires are located at the 0.1L, 0.3L, 0.5L, 0.7L, and 0.9L locations. The control voltage Vc for the 0.1L wire can be estimated an average of that indicated by the curve over the zone of effect of the 0.1L wire, e.g., from 0 to 0.2L, thus, $$\frac{1.87 + 1.95}{2} \times V_o.$$

Similarly, the 0.9L wire would have as its $V_c$, the average of $$\frac{1.0 + (-.59)}{2} \times V_o.$$

Given these estimated $V_c$ values, appropriate $V_b$ values can then be determined by the empirical relation of $V_b$ to $V_c$, relation (b).

Rather than forming La curves as a basis for estimate, tabular values can be determined for a system having a given number of wires. The technique for computing such voltage values is described next.

TECHNIQUE FOR COMPUTING VOLTAGE VALUES GIVEN N WIRES

Experiments with N-wire chargers have shown that the control voltage, $V_c(x)$ is approximately piecewise constant in N pieces in the x direction over the length of the charger. That is, $V_c(x)$ is fixed at a constant value over an interval on the film in which a particular corona wire is nearest. The rate of charging is highest near the corona wires, but everywhere within an interval the film tends to charge toward the same value, which by definition is the control voltage.

These experimental results mean that only piecewise constant functions are admissable as control functions, $V_c(x)$, changing value only at discrete values of x midway between corona wires. The sensitivity problem can therefore be expressed in a discrete rather than continuous formulation. The differential equation for charger operation then becomes a difference equation. The difference equation is determined directly from the differential equation, with $V_c(x)$ constant between discrete values of x. The sensitivity differential equation is discretized in a similar manner. To develop the difference equations for $V_f$ and S analogous to the differential equations (3) and (4), the solution of (3) is first expressed as $$V_f = V_f(0)e^{-ax} + \int_0^x aV_c e^{-a(x-\tau)}d\tau$$

which yields $$V_f = V_f(0)e^{-ax} + V_c(1-e^{-ax})$$

when $V_c$ is constant. Thus at the end of the $M^{th}$ interval of N intervals in a charger of the length L, $$V_f(M) = V_f(M-1)e^{-aL/N} + V_c(M-1)(1-e^{-aL/N}).$$

Subtracting $V_f(M-1)$ from both sides and defining $\Delta V_f = V_f(M) - V_f(M-1)$ yields $$\Delta V_f = (e^{-aL/N}-1)V_f(M-1) + (1-e^{-aL/N})V_c(M-1),\ V_f(0)=0. \quad (11)$$

The difference equation involving S is obtained in a similar manner as $$\Delta S = -\frac{L}{N}e^{-aL/N}V_f(M-1) + (e^{-aL/N}-1)S(M-1) + \frac{L}{N}e^{-aL/N}V_c(M-1),\quad S(0)=0. \quad (12)$$

A discrete rather than continuous formulation of the Pontryagin minimum principle is applied to the above system of two difference equations to obtain $V_c(M)$, $M=0, 1, \ldots N-1$, i.e., the control voltages for the N wires (or N sets of wires) of the corona charger. Numerical results are obtained for particular configurations, rather than closed-form analytic expressions for $V_c$ and $V_f$. Table I below shows such $V_c$ and $V_f$ values calculated in more detail by the analytic techniques described above for charging an exemplary system (having certain defined parameters and for which the ease of charging factor La varies by virtue of photoconductor velocity variations) to an exit voltage $V_o$ of −450 volts.

TABLE 1

| Photoconductor Vel. (cm/s) | Ease of Charging La | $V_{c1}$, ($V_{b1}$) | $V_{c2}$, ($V_{b2}$) | $V_{c3}$, ($V_{b3}$) | $V_{c4}$, ($V_{b4}$) | $V_f$ (peak) |
|---|---|---|---|---|---|---|
| 25 | 1.91 | −1153, (−729) | −1153, (−729) | −255, (+131) | −255, (+131) | −727 |
| 25 | 1.91 | −999, (−572) | −978, (−550) | −748, (−319) | −63, (+309) | −661 |
| 30 | 1.59 | −1387, (−976) | −1387, (−976) | −121, (+258) | −121, (+258) | −804 |
| 30 | 1.59 | −1265, (−847) | −1387, (−735) | −762, (−337) | +149, (+493) | −708 |

TABLE 1-continued

| Photoconductor Vel. (cm/s) | Ease of Charging La | $V_{c1}$, ($V_{b1}$) | $V_{c2}$, ($V_{b2}$) | $V_{c3}$, ($V_{b3}$) | $V_{c4}$, ($V_{b4}$) | $V_f$ (peak) |
|---|---|---|---|---|---|---|
| 40 | 1.19 | −1841, (−1491) | −1841, (−1491) | +248, (+578) | +248, (+578) | −944 |
| 40 | 1.19 | −1833, (−1482) | −1477, (−1075) | −701, (−278) | +659, (+918) | −814 |
| 50 | .95 | −2243, (−1996) | −2243, (−1996) | +714, (+962) | +714, (962) | −1062 |
| 50 | .95 | −2379, (−2179) | −1701, (−1328) | −527, (−112) | +1220, (+1358) | −925 |
| 60 | .79 | −2580, (−2467) | −2580, (−2467) | +1219, (+1358) | +1219, (+1358) | −1156 |
| 60 | .79 | −2855, (−2894) | −1815, (−1460) | −273, (+122) | +1774, (+1771) | −1013 |

The system for which the above values were calculated included four separately-biasable, 8 cm long corona wires, spaced 1 cm from the photoconductor and 2 cm center-to-center and energized with a 400 Hz, 15 kV (p-p) voltage. The capacitance of the charged photoconductor was 165 pf/cm$^2$. La factors (LK/2Cv) were calculated at $V_b=V_o$. Measured average charger efficiency K/2 was determined by the test and regression procedures described above, relation (a) to depend upon bias voltage, $V_b$, according to the empirical relation, $K/2=9.27\times10^{-10}-1.039\times10^{-13}\times V_b-4.72\times10^{-17}\times V_b$. Similarly, control voltage, $V_c$, was found to depend upon bias voltage, $V_b$, according to the empirical relation, $V_c=-406+1.085V_b+8.25\times10^{-5}\times V_b^2$, relation (b) above. The above parameter values and equations (11) and (12) were used in the computation of bias voltages for zero sensitivity. Two separate zero-sensitivity voltage programs were calculated for each photoconductor velocity, the first listed program involving setting the two overcharging corona wires for the same control voltage (at the same bias) and similarly matching the two discharging corona wires. The second listed program provides separate control voltages for each of the four electrodes.

These numerical results are approximations since their calculation depends on the six idealizing assumptions listed earlier, except that $V_c(x)$ changes only at discrete positions. There is the further approximation that $V_c(x)$ depends only upon the $V_c$ of the nearest corona wire. Since actual charging configurations depart in varying degrees from these assumptions, the calculated results should be used for initial rough guidance as to bias voltage and film voltage response required to obtain the desired (generally low) sensitivity. Final adjustments should be performed experimentally, by a procedure outlined later.

With the foregoing understanding of the reason and manner for selecting appropriate overcharge-discharge control voltages, description of exemplary structural embodiments of the invention will be useful. The electrophotographic copying apparatus shown in FIG. 5 is a typical one for which charging according to the present invention is advantageous. The apparatus shown in that Figure is conventional with the exception of the primary charging station 10, and generally includes a photoconductor 2 which can comprise a photoconductive insulator layer overlying a conductive layer on a film support and is moved around an endless path passing the primary charging station 10, an exposure station 11, a development station 12, a transfer station 13, a cleaning station 14, and an erase illumination station 15. Copy sheets are fed from a supply 16 past the transfer station 13 to a fusing station 17 and a completed copy bin 18. As indicated above, such continuous copy apparatus requires primary charging of the photoconductor while rapidly moving past charging unit 10.

As shown in more detail in FIG. 6, the charging station can comprise a shield 20 having electrically insulative end blocks 21 and 22 in which the ends of electrode wires 23, 24, 25 and 26 are mounted. As shown, the left ends of the electrode wires are coupled to separate energizing sources $V_1$, $V_2$, $V_3$ and $V_4$ by connector plates **23*a*, 24*a*, 25*a* and 26*a* which are respectively electrically isolated by compartmental structure of end block 21**.

Figure 7:
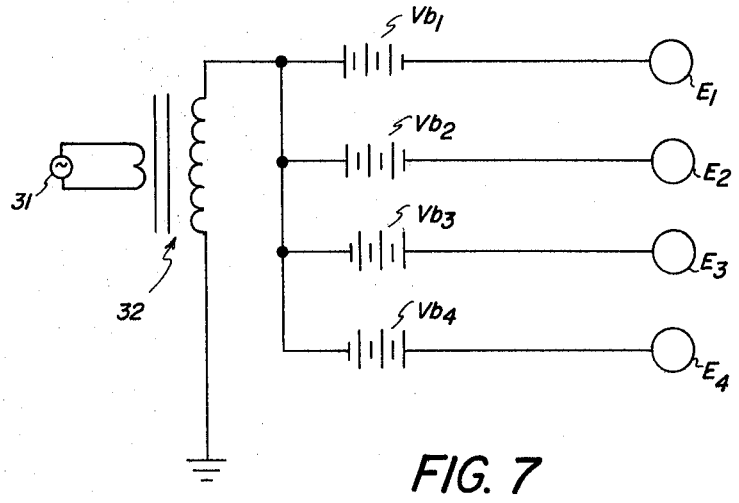
FIGS. 7 and 8 are circuit diagrams of different exemplary embodiments for energizing charging devices according to the present invention.

One means for energizing the charging unit in accord with the present invention is shown in FIG. 7. As shown, an AC source 31 is applied to the primary coil of high voltage transformer 32, the secondary coil of which provides high voltage alternating current to the corona discharge electrodes $E_1$, $E_2$, $E_3$ and $E_4$. The electrodes are connected, respectively in parallel. In series with each electrode, respectively, is a predetermined DC bias source, indicated as separate sources $V_{b1}$, $V_{b2}$, $V_{b3}$, and $V_{b4}$. By this configuration each discharge electrode is energized with predeterminedly biased AC power, the bias level depending on the polarity and magnitude of the voltages $V_{b1}$–$V_{b4}$.

Figure 8:
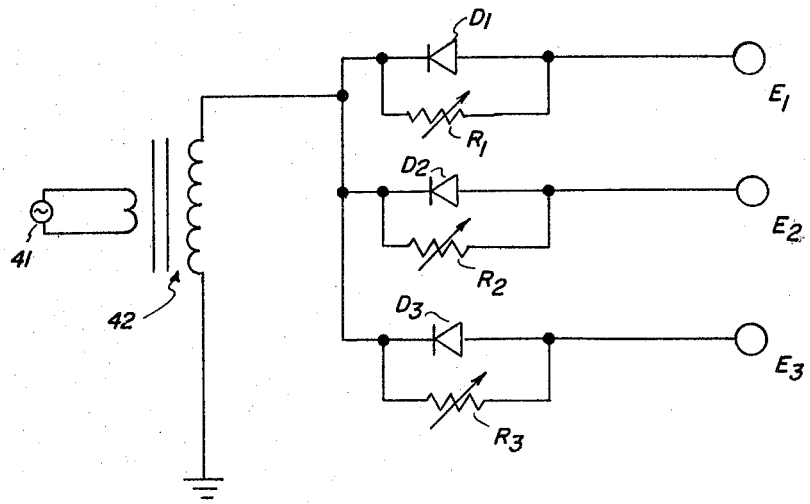

An alternative mode for energizing the discharge electrodes is illustrated in FIG. 8. As shown in that figure, AC source 41 is coupled to high voltage transformer 42 which supplies high voltage alternating current through the parallel current branches to electrodes $E_1$, $E_2$ and $E_3$. Each branch circuit respectively comprises a diode ($D_1$, $D_2$ and $D_3$) in parallel with a resistance ($R_1$, $R_2$ and $R_3$). The resistance values are selected to decrease the voltage that is applied to the discharge electrode during the half-cycle in which the parallel diode is not conducting. This effectively unbalances the corresponding electrical fields and thus the charge deposition during successive half-cycles. The equilibrium voltage, toward which the photoconductor is charged when under the influence of the respective discharge electrodes $E_1$, $E_2$ and $E_3$, is therefore controlled by the values of $R_1$, $R_2$ and $R_3$. The resistances can be variable as shown to permit adjustment of the unbalancing of the corona fields. The polarity of dominant charge is controlled by the direction of the diodes. The FIG. 8 circuit for unbalancing of the AC field to a particular net potential value is, in general, equivalent in function to the DC biasing described with respect to FIG. 7; and, in accordance with the present invention, the biasing of an alternating current to a net potential level can include both of the foregoing and other equivalent biasing techniques.

Having now described exemplary structural arrangements for practicing the present invention, the manner in which estimated control voltages, e.g., from Table I or La curves, can be fine tuned in an operating apparatus will be described. That is the Table I or the La Curve technique may be used to estimate reasonable bias values to try initially, and the peak photoconductor voltage to expect. The following procedure should then be used for final adjustments:

(1) Note the value of $V_o$, the exit voltage on the photoconductor and adjust both bias levels (overcharge and discharge) by equal amounts to obtain the desired $V_o$. For example if the actually obtained $V_o$ was −460 volts, the $V_b$ magnitudes might be decreased about 15 volts to make $V_o = -450$.

(2) After obtaining the desired $V_o$ according to step (1) above, next vary the film velocity and note the velocity $v_1$ at which the maximum $V_o$ occurs. If $v_1$ is slower than the nominal velocity, the photoconductor is not being overcharged enough and the overcharging and discharging bias levels should be adjusted by equal but opposite amounts to increase overcharging. Conversely, if $v_1$ is faster than nominal, adjust the two bias levels by equal and opposite amounts to decrease that overcharging. This routine should be repeated until the maximum $V_o$ occurs at the nominal velocity.

OR (2a) If it is convenient to vary film velocity, the charger can be turned off abruptly to obtain a strip chart recording showing the instantaneous film voltage profile under the charger. If the peak voltage $V_p$ is lower than expected, adjust the two bias levels by equal and opposite amounts to increase the overshoot. Conversely if $V_p$ is higher than expected, adjust the two bias levels by equal and opposite amounts to decrease the overshoot. Repeat this routine until the actual peak film voltage matches the expected value from Table I.

(3) Finally, go back to step (1), iterating until both $V_o$ and $v_1$ (or $V_p$) are accurate enough. If step (2) is followed, zero sensitivity with respect to velocity is assured. If step (2a) is followed, zero sensitivity depends on the degree of accuracy of the estimate of the overshoot $V_p$ from Table I (i.e., the degree of correspondence between the operating parameters and the parameters assumed in formulating Table I or its counterpart).

Figure 9:
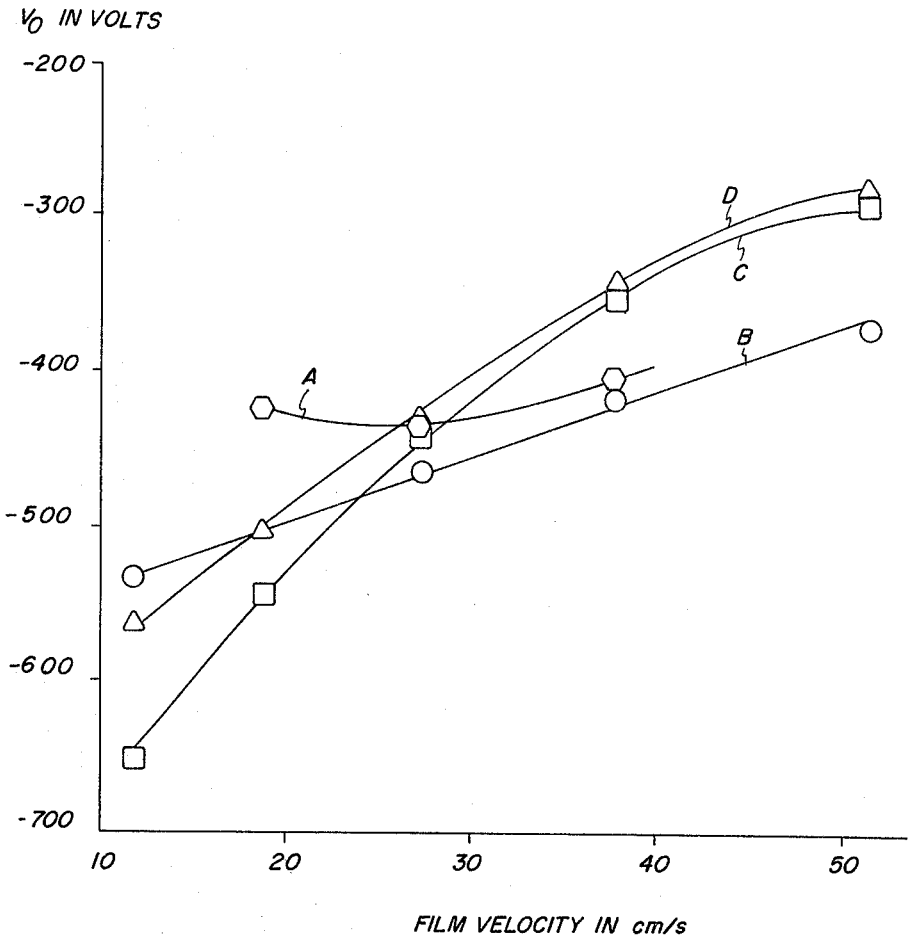
FIG. 9 is a graph illustrating improved results achieved in accordance with one mode of the present invention.

For further understanding of the advantageous effect of low-sensitivity charging according to the present invention, reference is made to FIG. 9. In that figure curve A indicates the photoconductor exit voltage provided by a 3-wire, overcharge-discharge system constructed according to the present invention, over a range of photoconductor velocities from about 20 to 40 cm/sec. The energizing source was 15 kV (p-p) and bias of the successive separately biased coronas was respectively −745 volts, −745 volts and +605 volts.

For comparison to curve A charging, curve B illustrates open wire DC charging, curve C illustrates a 13 kV (p-p) AC charger biased at −590 (to obtain a nominal voltage of −450 volts at nominal velocity) and curve D illustrates another AC charger 15 kV (p-p) also biased to obtain the nominal voltage (−450 volts) at nominal velocity. It can be seen that the variation in final charge is significantly less in the system provided according to the present invention, represented by curve A.

Figure 10A:
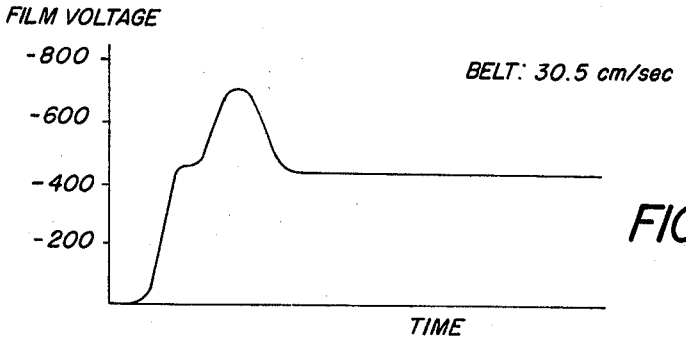
FIG. 10 is a graph showing photoconductor voltage profiles during charging in accordance with certain modes of the present invention.
Figure 10B:
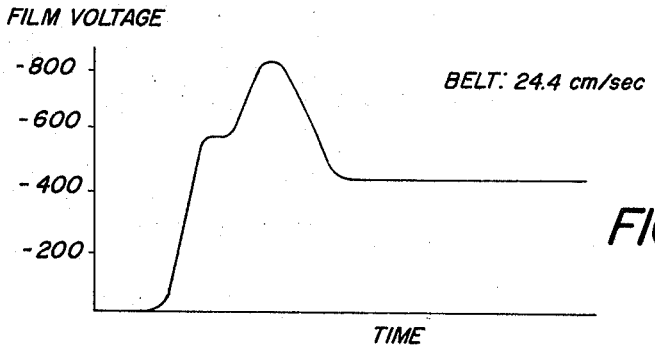
Figure 10C:
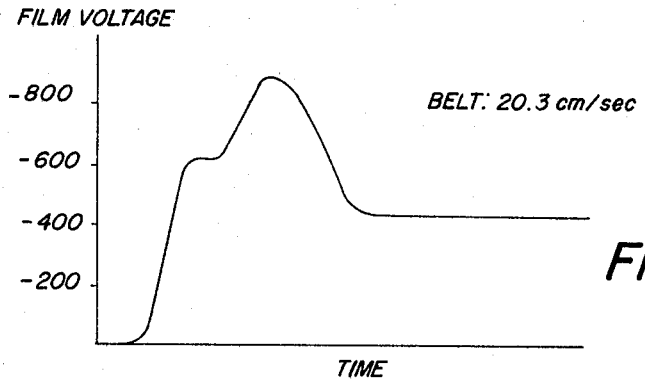

FIGS. 10*a–c* show photoconductor voltage profiles across the film obtained by instantaneously turning off all chargers. The apparatus producing these profiles had 3 AC energized corona wires, respectively biased at −2025 volts, −1350 volts and +900 volts. FIG. 10*a* illustrates the profile at a photoconductor velocity of 30.5 cm/sec, FIG. 10*b* the profile at 25.4 cm/sec and FIG. 10*c* the profile at 20.3 cm/sec. It will be seen that although the intermediate voltage levels (i.e., the prior-to-exit voltages) vary for different photoconductor velocities, the exit voltages remain substantially constant.

The above description of preferred embodiments has been with respect to electrographic embodiments of the invention, for which it is particularly useful. However, the invention is deemed to have potential advantage for use in other electrostatic charging applications (e.g., of other dielectric members) and its scope should not be limited to the specifically disclosed applications.

The invention has been described in detail with particular reference to certain preferred embodiments thereof, but it will be understood that variations and modifications can be effected within the spirit and scope of the invention.

What is claimed is:

1. In electrophotographic apparatus of the type in which a photoconductor is moved downstream through a primary charging station, an improved corona charging device for forming a primary charge of nominal potential on an imaging surface of the photoconductor, said device comprising:

(a) first corona means for charging such surface, during passage through a first portion of said charging station, to an overcharge potential which is of the same polarity as said nominal potential and is substantially in excess of said nominal potential; and (b) second corona means for discharging such surface, during passage through a second portion of said charging zone downstream from said first portion, toward a potential that is below said nominal potential by a predetermined magnitude such that said surface exits said charging zone at said nominal potential;

whereby nominal charge is placed on such surface with improved low-sensitivity to variations in charging system parameters such as photoconductor capacitance, photoconductor velocity and charging efficiency.

2. The invention defined in claim 1 wherein the peak potential formed on said surface by said first charging means exceeds said nominal potential by at least 20% of the value of said nominal potential.

3. The invention defined in claim 1 wherein the potential toward which such surface is discharged is at least 100 volts below said nominal potential.

4. The invention defined in claim 1 wherein said second corona means includes a source of DC-biased, high-voltage, alternating current.

5. The invention defined in claim 1 wherein the peak potential formed on said surface by said first charging means exceeds said nominal potential by at least 20% of the value of said nominal potential and the potential toward which said surface is discharged is at least 100 volts below said nominal potential.

6. Improved charging apparatus for use in electrophotographic machines of the type in which a photoconductive insulator member is moved downstream through a charging station during copying cycle, to provide a primary charge of nominal polarity and potential on such member, said apparatus comprising:

(a) first corona means, operative during movement of such member through a first zone of said charging station, for charging the surface of such member to a peak potential substantially exceeding said nominal potential; and (b) second corona means, operative during movement of the photoconductor member through a second, downstream charging zone, for discharging such surface toward a discharge potential substantially below said nominal potential;

said peak potential and said discharge potential being selected such that such surface exits said charging station at said nominal potential;

whereby the plot of variation in exit potential to variation in photoconductor capacitance or velocity of said charging apparatus exhibits a zone of zero slope.

7. The invention defined in claim 6 wherein said peak potential and discharge potential are selected with respect to charging system parameters such that the exit voltage is on a portion of said plot having a normalized slope of absolute value $\leqq 0.10$.

8. The invention defined in claim 7 wherein said second corona means includes at least one corona discharge electrode and means for energizing said electrode with an alternating current biasing to a potential level which is at least 400 volts below said nominal potential for negative polarity nominal potential, or at least 200 volts below said nominal potential for positive polarity nominal potential.

9. The invention defined in claim 7 wherein said first corona means charges said surface to a peak potential which is at least 50 volts above said nominal potential.

10. The invention defined in claim 7 wherein said second corona means includes at least one corona discharge electrode and means for energizing said electrode with an alternating current biased to a potential level which is at least 400 volts below said nominal potential for negative polarity, or at least 200 volts below for positive polarity, and said first corona means charges said surface to a peak potential which is at least 50 volts above said nominal potential.

11. The invention defined in claim 7 wherein at least one of said corona means comprises a discharge electrode and diode means and resistance means coupled in parallel between a source of alternating current and said discharge electrode for providing said potential bias.

12. Apparatus for uniformly electrostatically charging the surface of a dielectric web which is moved downstream through a charging station to a nominal potential level, said apparatus comprising:

(a) first corona means for charging such surface, during passage through a first portion of said charging station, to an overcharge potential which is of the same polarity as said nominal potential and is substantially in excess of said nominal potential; and (b) second corona means for discharging such surface, during passage through a second portion of said charging zone downstream from said first portion, toward a potential that is below said nominal potential by a predetermined magnitude such that said surface exits said charging zone at said nominal potential;

whereby nominal charge is placed on such surface with improved low-sensitivity to variations in charging system parameters such as web capacitance, web velocity and charging efficiency.

13. The invention defined in claim 12 wherein the peak potential formed on said surface by said first charging means exceeds said nominal potential by at least 20% of the value of said nominal potential.

14. The invention defined in claim 12 wherein the potential toward which such surface is discharged is at least 100 volts below said nominal potential.

15. The invention defined in claim 12 wherein said second corona means includes a source of DC-biased, high-voltage, alternating current.

16. The invention defined in claim 12 wherein the peak potential formed on said surface by said first charging means exceeds said nominal potential by at least 20% of the value of said nominal potential and the potential toward which such surface is discharged is at least 100 volts below said nominal potential than nominal potential.

17. Apparatus for electrostatically charging a dielectric support which is moved downstream through a charging station to a nominal potential level, said apparatus comprising:

(a) first corona means, operative during movement of such member through a first zone of said charging station, for charging the surface of such support to a peak potential substantially exceeding said nominal potential; and (b) second corona means, operative during movement of the support through a second, downstream charging zone, for discharging such surface toward a discharge potential substantially below said nominal potential;

said peak potential and said discharge potential being selected such that such surface exits said charging station at said nominal potential, and the plot of variation in exit potential to variation in support capacitance or velocity of said charging apparatus defines a curve having a zone of zero slope.

18. The invention defined in claim 17 wherein said peak potential and discharge potential are selected with respect to charging system parameters such that the exit voltage is on a portion of said curve having a normalized slope of absolute value $\leqq 0.10$.

19. The invention defined in claim 18 wherein said second corona means includes at least one corona discharge electrode and means for energizing said electrode with an alternating current biased to a potential level which is at least 400 or 200 volts below said nominal potential for negative and positive polarity nominal potentials respectively.

20. The invention defined in claim 18 wherein said first corona means charges said surface to a peak potential which is at least 50 volts above said nominal potential.

21. The invention defined in claim 18 wherein said second corona means includes at least one corona discharge electrode and means for energizing said electrode with an alternating current biased to a potential level which is at least 400 or 200 volts below said nominal potential, for negative and positive polarity nominal potentials respectively, and said first corona means charges said surface to a peak potential which is at least 50 volts above said nominal potential.

22. A method for forming a uniform electrostatic charge of nominal potential on a dielectric web which is moving along a feed path past a charging station, said method comprising:

(a) first, corona charging the web to an initial potential level which is of the same polarity as said nominal potential and is of magnitude substantially greater than said nominal potential; and (b) subsequently discharging the web toward a potential that is below said nominal potential by a predetermined magnitude such that the web exits said charging station at said nominal potential level;

whereby the nominal charge is placed on said web with improved low-sensitivity to variation in charging system parameters such as photoconductor capacitance, photoconductor velocity and charging efficiency.

23. An electrographic method for forming a uniform electrostatic charge of nominal potential on the imaging surface of a photoconductor which is moved downstream through a primary charging station, said method comprising:

(a) first corona charging such surface, during passage through a first portion of said charging station, to an overcharge potential which is of the same polarity as said nominal potential and is substantially in excess of said nominal potential; and (b) subsequently corona discharging such surface, during passage through a second portion of said charging zone downstream from said first portion, toward a potential that is below said nominal potential by a predetermined magnitude such that said surface exits said charging zone at said nominal potential;

whereby nominal charge is placed on such surface with improved low-sensitivity to variations in charging system parameters such as photoconductor capacitance, photoconductor velocity and charging efficiency.

24. The invention defined in claim 23 wherein the peak potential formed on said photoconductor by said first charging means exceeds said nominal potential by at least 20% of the value of said nominal potential.

25. The invention defined in claim 23 wherein the potential toward which such surface is discharged is at least 100 volts below said nominal potential.

26. The invention defined in claim 23 wherein the peak potential formed on said photoconductor by said first charging means exceeds said nominal potential by at least 20% of the value of said nominal potential and the potential toward which such surface is discharged is at least 100 volts below said nominal potential than nominal potential.

27. A method for charging a photoconductive insulator member which is moved downstream through a charging station during copying cycle, to provide a primary charge of nominal polarity and potential on such member, said method comprising:

(a) first charging the surface of such member to a peak potential substantially exceeding said nominal potential during movement of such member through a first zone of said charging station; and (b) then discharging such surface toward a discharge potential substantially below said nominal potential during movement of the photoconductor member through a second, downstream charging zone;

said peak potential and said discharge potential being selected such that such surface exits said charging station at said nominal potential and that the plot of variation in exit potential to variation in photoconductor capacitance or velocity of said charging apparatus defines a curve having a zone of zero slope.

28. The invention defined in claim 27 wherein said peak potential and discharge potential are selected with respect to charging system parameters such that the exit voltage is on a portion of said curve having a normalized slope of absolute value $\leqq 0.10$.

* * * * *